US005591011A

United States Patent [19]

Mantooth et al.

[11] Patent Number: 5,591,011

[45] Date of Patent: Jan. 7, 1997

[54] MULTI-REFRIGERANT COMPRESSOR

[75] Inventors: Michael N. Mantooth, Liverpool; Kevin D. Williams, Syracuse; Bruce A. Fraser, Manlius, all of N.Y.

[73] Assignee: Carrier Corporation, Syracuse, N.Y.

[21] Appl. No.: 529,794

[22] Filed: Sep. 18, 1995

[51] Int. Cl.[6] ..... F04B 73/10; F04B 17/03; F04B 39/02

[52] U.S. Cl. ..... 417/199.1; 417/295; 417/357; 417/372

[58] Field of Search ..... 417/199.1, 295, 417/357, 372, 415, 439

[56] References Cited

U.S. PATENT DOCUMENTS

| | | | |
|---|---|---|---|
| 2,504,748 | 4/1950 | Steenstrap | 417/372 |
| 2,741,424 | 4/1956 | Ploeger | 417/295 |
| 2,926,840 | 3/1960 | Soumerai | 417/372 |
| 2,948,458 | 8/1960 | Nicholas et al. | 417/372 |
| 3,123,287 | 3/1964 | Neubauer | 417/372 |
| 3,171,589 | 3/1965 | Cramer et al. | 417/372 |
| 3,713,513 | 1/1973 | Harris et al. | 417/372 |
| 5,211,542 | 5/1993 | Fraser et al. | 417/295 |
| 5,476,370 | 12/1995 | Wood | 417/435 |

*Primary Examiner*—Richard A. Bertsch
*Assistant Examiner*—William Wicker

[57] ABSTRACT

The oil sump and suction plenum of a hermetic compressor are in continuous fluid communication through an oil equalization port assembly. Additionally, communication is established between the oil sump and the suction plenum if pressure in the oil sump is greater than that in the suction plenum by more than a few pounds. Multiplexing is established through a port in the suction plenum.

2 Claims, 2 Drawing Sheets

MULTI-REFRIGERANT COMPRESSOR

BACKGROUND OF THE INVENTION

The development and introduction of new refrigerants and their associated oils in recent years has required changes to compressor designs that are not yet obsolete in order to provide satisfactory performance. Basically, the use of new synthetic oil with the HFC refrigerants mandates compressor redesigns for improved lubrication during transient conditions such as those associated with start up. The inherent characteristics of the new synthetic oils cause the adsorption and desorption of refrigerants at vastly different rates than the mineral oils. When the refrigerant flashes out of the oil, standard compressor designs maintain the resulting increased pressure in the oil sump. This results in higher than normal sump pressures during these transient conditions resulting in performance degradation of the bearing and lubrication system. This was partially addressed in commonly assigned U.S. Pat. No. 5,211,542 which limits the pressure differential between the suction plenum and the oil sump. Additionally, the new refrigerants do not transport oil as well as conventional refrigerants.

SUMMARY OF THE INVENTION

Various interdependent component redesigns result in lower sump pressure during transients, decreased unit bearing loads, and improved lubrication. A critically sized vent hole in a lightly loaded spring check valve installed in the wall between the suction cavity and the oil sump allows for rapid pressure equalization during these transients without affecting the oil circulation rate under normal operating conditions. A reconfigured oil delivery system provides oil at higher pressure to redesigned main bearings. This along with a modified main bearing venting scheme ensures decreased bearing stresses and improved lubrication. The spring loaded check valve is required when the compressors are multiplexed by placing them in parallel in the same circuit and if they have interconnected oil equalization lines.

It is an object of this invention to provide a compressor suitable for use with multiple HFC refrigerants and synthetic oil as well as conventional refrigerants and oils.

It is another object of this invention to provide an arrangement for multiplexing compressors using HFC refrigerants and synthetic oil. These objects, and others as will become apparent hereinafter, are accomplished by the present invention.

Basically, rapid pressure equalization during transients, a higher oil pressure to the bearings and modified bearing venting improves lubrication while reducing bearing stresses. A lightly loaded check valve providing pressure equalization also permits multiplexing of compressors.

BRIEF DESCRIPTION OF THE DRAWING

For a fuller understanding of the present invention, reference should now be made to the following detailed description thereof taken in conjunction with the accompanying drawing wherein.

DESCRIPTION OF THE PREFERRED EMBODIMENT

Figure 2:
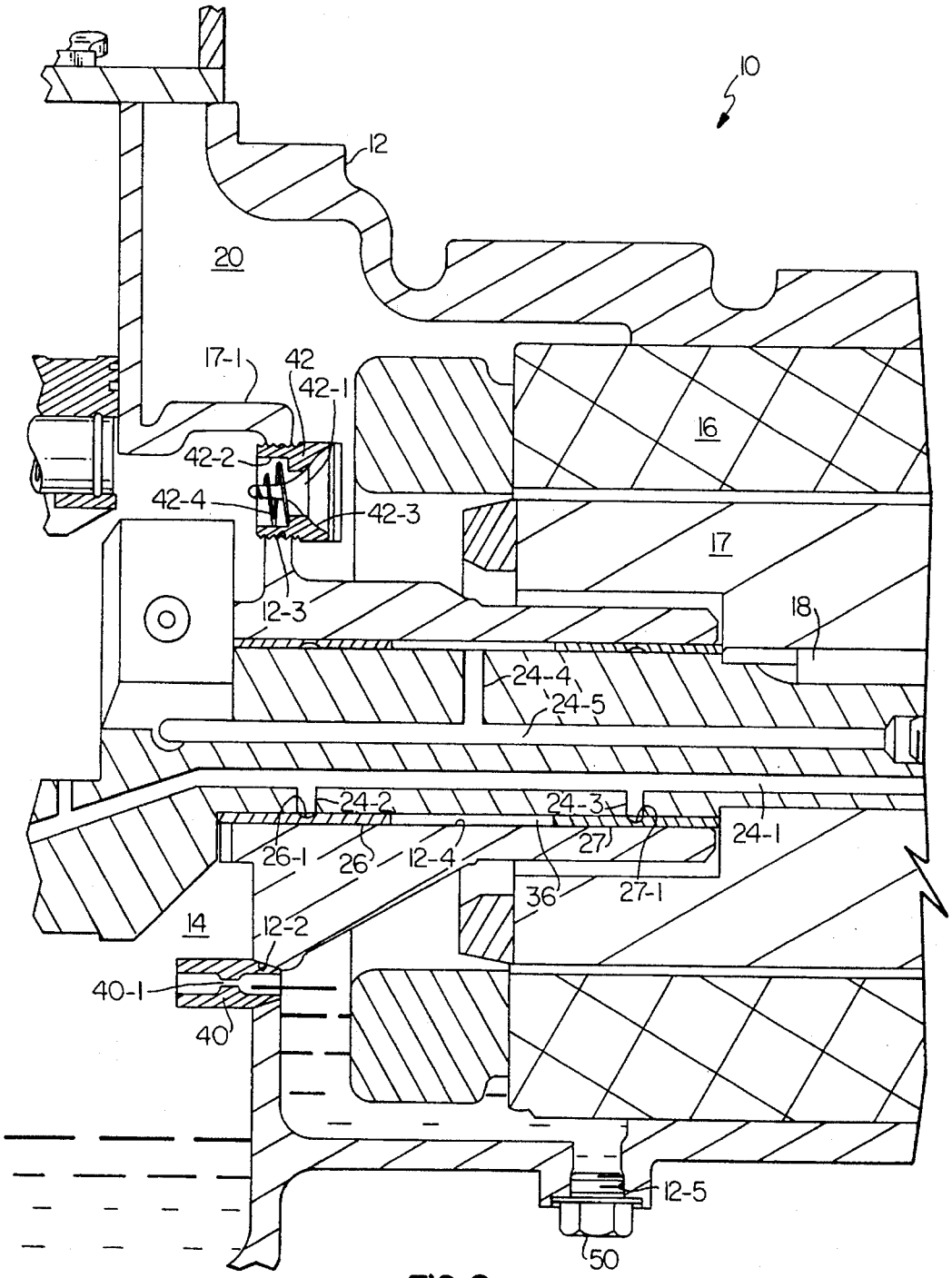
FIG. 2 is an enlarged view of a portion of FIG. 1.

In the Figures, the numeral 10 generally designates a low side semi-hermetic compressor having a casing 12. Casing 12 is divided into an oil sump 14 containing gaseous refrigerant with liquid oil 15 located therein, suction plenum 20 and discharge plenum 22. Oil sump 14 is separated from suction plenum by a wall or partition 12-1 having threaded bores 12-2 and 12-3. As best seen in FIG. 2, an oil equalization port assembly 40 having an orifice 40-1 is threadably received in threaded bore 12-2. Similarly, a crankcase pressure equalization valve assembly 42 is threadably received in threaded bore 12-3. Normally closed valve member 42-1 is located in bore 42-2 containing valve seat 42-3. Valve member 42-1 is biased onto seat 42-3 by spring 42-4 and will open on a two to three psi pressure difference between oil sump 14 and suction plenum 20.

Compressor 10 is driven by a motor made up of stator 16 which is secured to casing 12 and rotor 17 which is secured to crankshaft 24 by key 18. Crankshaft 24 is supported by main bearings 26 and 27 which are carried by partition 12-1 and by bearing head 28 which receives crankshaft 24 in a bearing relationship. Bearing head 28 and the corresponding end of crankshaft 24 coact to define an oil pump assembly of the type described in commonly assigned, copending application Ser. No. 08/157,544, now U.S. Pat. No. 5,476,370, which is hereby incorporated by reference. Crankshaft 24 contains an oil distribution system in the form of a plurality of interconnecting drilled passages, some of which have a plugged end, which collectively define an oil gallery. The oil gallery feeds the bearing defined by bore 28-1 in bearing head 28 as well as each of the six connecting rods with only connecting rods 30 and 31 being illustrated and connected to pistons 32 and 33, respectively. Eccentrically located bore 24-1 feeds oil to radial bores 24-2 and 24-3 which feed main bearings 26 and 27, respectively. As is clearly shown in the Figures, bearings 26 and 27 are axially spaced and coact with crankshaft 24 and bore 12-4 in partition 12 to define an annular cavity 36 which receives oil and outgassed refrigerant passing from bearings 26 and 27. Cavity 36 connects with radial bore 24-4 which connects via axial bore 24-5 with oil sump 14.

Figures 1, 3:
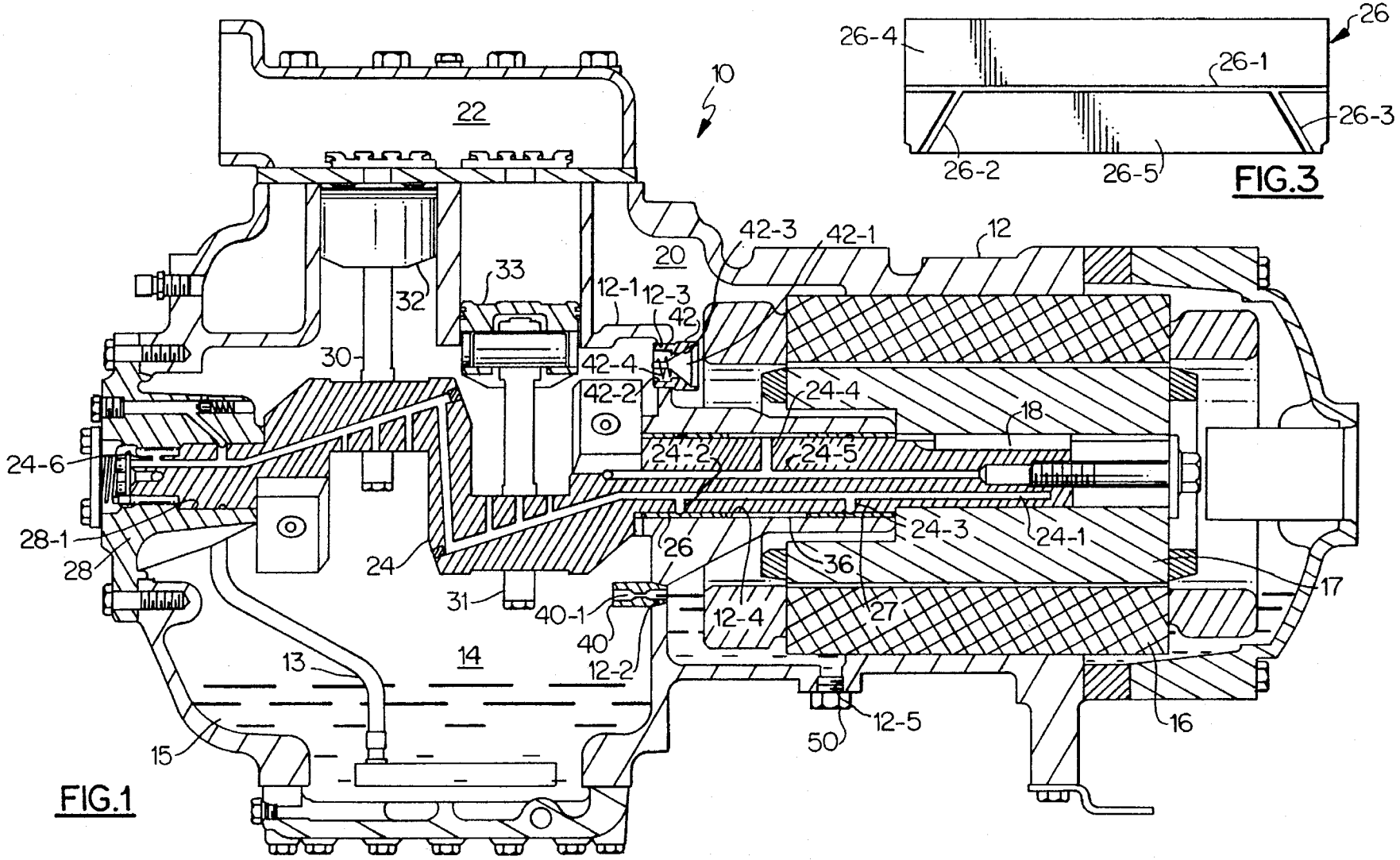
FIG. 1 is a partially sectioned view of a semi-hermetic reciprocating compressor employing the present invention.
FIG. 3 is a developed view of a main bearing.

In operation, assuming that compressor 10 has been shutdown and the refrigerant system has equalized, the gaseous refrigerant in oil sump 14, the oil 15, the suction plenum 20 and the discharge plenum 22 will initially be at the same pressure and the oil 15 will have a significant amount of refrigerant contained therein. As compressor 10 starts to run, refrigerant vapor is drawn from the suction plenum 20, compressed, and the compressed refrigerant is delivered to the discharge plenum 22 from which it passes to the refrigeration system. The drawing of refrigerant vapor from suction plenum 20 causes refrigerant vapor to be drawn into the suction plenum 20 from the refrigeration system. The drawing of refrigerant vapor from the suction plenum 20 has a major effect on the oil sump 14. If there is a reasonable degree of communication, the oil sump 14 effectively becomes part of the suction plenum 20. Unlike in the suction plenum 20, the drawing off of refrigerant vapor from the oil sump 14 causes a boiling off of refrigerant from the oil 15 with a resulting generation of froth. The froth generation, however, is the major problem since the boiling out of refrigerant can result in froth, rather than liquid oil, being drawn into oil pump inlet 24-6. As a result, the oil pump can deliver insufficient oil as well as undesired gaseous refrigerant to the components requiring lubrication. The oil pump can become vapor locked with bearing damage and failure occurring under these conditions. Oil equalization port assembly 40 permits a restricted pressure equalization between suction plenum 20 and sump 14. Valve 42-2 opens on a pressure differential between suction plenum 20 and oil sump 14 on the order of 2 to 3 psi to provide a rapid pressure equalization to within the biasing force of spring 42-4. Normally, the rapid pressure equalization would be undesirable because of the attendant rapid flashing of the refrigerant out of the oil. However, the light loading of valve 42-2, provides a means of rapid pressure equalization between sump 14 and suction plenum 20 and allows the refrigerant to quickly flash out of the oil and to pass into the suction plenum 20 thereby ensuring that a more homogeneous oil is being picked up via oil pickup 13 and delivered to the piston rods and bearings by the oil pump. The oil is fed via bore 24-1 to bores 24-2 and 24-3 which feed directly into the annuli 26-1 and 27-1 of main bearings 26 and 27, respectively. Bores 24-2 and 24-3 are located so as to ensure that both of the main bearings 26 and 27 are equally lubricated. Main bearings 26 and 27 are identical other than having different orientations. As shown in FIG. 3, which is labeled for bearing 26 but would apply to bearing 27, bore 24-2 feeds annular groove 26-1. Annular groove 26-1 connects with grooves 26-2 and 26-3 which connect groove 26-1 with annular cavity 36. Each of grooves 26-1 through 3 face the moving crankshaft 24 to provide lubrication. Annular groove 26-1 divides bearing 26 into two sections, 26-4 which is continuous and 26-5 which is broken by grooves 26-2 and 26-3. Typically, feed grooves 26-2 and 26-3 would extend over both section 26-4 and section 26-5. By eliminating groove 26-3 from section 26-4, the bearing 26 is able to carry load in all directions equally since feed grooves 26-2 and 26-3 reduce the area for carrying load and disrupt the oil film. Annular groove 27-1 of bearing 27 is similarly connected to cavity 36. Bearings 26 and 27 do not have vent grooves, per se, which increases the bearing area thereby improving the load carrying capability. To provide venting, bore 24-4 is provided in crankshaft 24 and it interconnects annular cavity 36 with crankshaft vent bore 24-5 so that venting of the refrigerant gases remaining in the refrigerant-oil mixture being pumped can take place and return to the oil sump 14 together with oil flowing from bearings 26 and 27. Venting is particularly important under transient conditions.

As contrasted with the sump vent check valve of U.S. Pat. No. 5,211,542, valve 42-1 completely closes and thereby allows for parallel compressor installations, or multiplexing, with existing oil control schemes. Specifically, the check valve of '542 provides the only communication between the oil sump 14 and suction plenum 20 whereas the present invention includes oil equalization port assembly 40 which has an orifice 40-1 providing restricted continuous communication between oil sump 14 and suction plenum 20. The problem that can occur in multiplexing is the drawing down of the lubricant in one compressor to the point where lubrication is inadequate thereby resulting in compressor failure. When the oil is drawn down in one compressor, the other compressor(s) typically contain an excess of oil. Therefore, means must be provided to remove excess oil from some compressors and return it to others. Orifice 40-1 is sized to slowly meter oil back into the gas flow so that it can return to the compressor(s) with a lowered oil level via the gas flow. By sizing orifice 40-1 small enough, typically 0.030 to 0.06 inches, a positive pressure will be created in the oil sump of the compressor as a result of blow-by past the piston rings during the compression process. The gas continually exists through orifice 40-1. In the case where excess oil is contained in the sump, the positive pressure provides the driving force to move the oil back into the gas flow which then gets pumped into the refrigeration system by the compressor allowing it to return to other compressor(s) with returned oil.

In the present invention the parallel compressor oil equalization port 12-5 is in communication with the suction plenum 20. Although port 12-5 is illustrated as closed by threaded plug 50, in multiplexing it would be in fluid communication with one or more corresponding ports in parallel compressor(s) via oil equalization line(s). Note, however, that oil can pass between the suction plenum 20 and oil sump 14 only when the level in one or both is up to orifice 40-1. As a consequence, other compressors cannot draw down the oil level in oil sump 14 below the level of orifice 40-1 and even where the oil level is above orifice 40-1, the oil in oil sump 14 can only be drawn off at the restricted rate permitted by orifice 40-1. Thus, if too much oil is pumped out of one compressor in a conventionally multiplexed system, as would be certain if the sump vent check valve 42 was not present, the oil returning from the refrigeration system would first fill the lead compressor, starving the secondary compressor(s) resulting in compression failure.

Although preferred embodiments of the present invention have been described and illustrated, other changes will occur to those skilled in the art. It is therefore intended that the scope of the present invention is to be limited only by the scope of the appended claims.

What is claimed is:

1. A semi-hermetic low side compressor means comprising:

casing means including partition means dividing said casing means into an oil sump and a suction plenum;

oil located in said oil sump;

a crankshaft having an axis and extending through said partition means;

main bearing means supporting said crankshaft in said partition means;

motor means located in said suction plenum and including a rotor which is secured to said crankshaft;

said crankshaft received by and coacting with a bearing head to define an oil pump for pumping said oil from said oil sump into an oil gallery located in said crankshaft;

an oil equalization port located in said partition means and providing continuous, restricted fluid communication between said oil sump and said suction plenum;

normally closed valve means located in said partition means and opening when pressure in said oil sump exceeds pressure in said suction plenum by an amount on the order of two to three pounds per square inch;

said main bearing means including a pair of axially spaced bearings receiving oil from said oil gallery;

vent structure including an annular chamber defined between said pair of axially spaced bearings and which is in fluid communication with an axial passage in said crankshaft communicating with said oil sump whereby rapid pressure equalization takes place between said oil sump and said suction plenum drawing outgassed refrigerant from said oil sump to said suction plenum.

2. The compressor means of claim 1 further including an oil equalization port connected to said suction plenum whereby said compressor means can be multiplexed.

* * * * *